US006354122B1

(12) United States Patent
Snoke

(10) Patent No.: US 6,354,122 B1
(45) Date of Patent: Mar. 12, 2002

(54) LOCK HAVING INTEGRAL STATUS INDICATORS

(75) Inventor: Steven R. Snoke, Batavia, OH (US)

(73) Assignee: The Stanley Works, New Britain, CT (US)

( * ) Notice: Subject to any disclaimer, the term of this patent is extended or adjusted under 35 U.S.C. 154(b) by 0 days.

(21) Appl. No.: 09/439,927

(22) Filed: Nov. 12, 1999

Related U.S. Application Data

(60) Provisional application No. 60/108,373, filed on Nov. 13, 1998.

(51) Int. Cl.[7] ..... E05B 41/00
(52) U.S. Cl. ..... 70/432; 70/434; 70/DIG. 59
(58) Field of Search ..... 70/368, 432, 424, 70/DIG. 59, 433

(56) References Cited

U.S. PATENT DOCUMENTS

| | | | | | |
|---|---|---|---|---|---|
| 4,683,741 | A | * | 8/1987 | Fields | 70/432 |
| 4,899,563 | A | * | 2/1990 | Martin | 70/368 X |
| 5,043,593 | A | * | 8/1991 | Tsutsumi et al. | 70/278.3 X |
| 5,111,007 | A | * | 5/1992 | Miller et al. | 70/432 X |
| 5,117,097 | A | * | 5/1992 | Kimura et al. | 235/439 |
| 5,337,588 | A | * | 8/1994 | Chhatwal | 70/278.3 |
| 5,473,236 | A | * | 12/1995 | Frolov | 70/277 X |
| 5,507,162 | A | * | 4/1996 | Chhatwal | 70/278.3 |
| 5,611,226 | A | * | 3/1997 | Fata | 70/454 |
| 5,986,564 | A | * | 11/1999 | Fraser | 70/278.2 X |
| 5,996,383 | A | * | 12/1999 | Adelmeyer et al. | 70/DIG. 59 X |
| 6,035,676 | A | * | 3/2000 | Hudspeth | 70/278.1 |

FOREIGN PATENT DOCUMENTS

| | | | | |
|---|---|---|---|---|
| DE | 3510438 | * | 10/1986 | 70/276 |
| EP | 0216241 | * | 4/1987 | 70/278.3 |

* cited by examiner

*Primary Examiner*—Lloyd A. Gall
(74) *Attorney, Agent, or Firm*—Pillsbury Winthrop LLP

(57) ABSTRACT

A key lock for use on a storage device, primarily a tool box, tool chest or workstation, having integral status indicators for giving a visual indication of whether the storage device is in a locked or unlocked condition. The key lock is preferably comprised of a core portion housing the internal workings of the lock mechanism and a shell portion, which surrounds at least a part of the core portion. At least one LED is secured in the shell portion. A face portion is attached to one end of the core portion, and is designed to receive a key. The other end of the core portion is adapted for attachment to other lock system components. The indicators on the key lock provide visual verification of the locked or unlocked status of the storage device, without the need to manually check each compartment.

21 Claims, 7 Drawing Sheets

LOCK HAVING INTEGRAL STATUS INDICATORS

This application is based on provisional application Ser. No. 60/108,373, filed Nov. 13, 1998, entitled "LOCK HAVING INTEGRAL STATUS INDICATORS."

BACKGROUND AND SUMMARY OF THE INVENTION

The present invention relates to the field of locks, and more particularly, to an improved lock system having integral status indicators.

Tool boxes, tool chests and workstations, have traditionally been installed with lock systems that are hard to service, require high actuation force, and are not easily installed in workstations of different sizes. The demand for, and cost of, heavy-duty workstations is on the rise. Accordingly, the present invention provides a flexible lock system that may be used in many different types of workstations and with workstations of many sizes. The flexibility of the lock system of the present invention allows easy and cost-effective integration in different types of workstations, with workstations of many sizes, and with workstations having various drawer arrangements.

One embodiment of the lock system of the present system is designed to allow low torque manipulation. The transfer channel of the present invention moves in the horizontal plane to lock and unlock banks of drawers. This horizontal actuation requires much less torque in manipulating the lock system as compared to traditional lock systems which operate in the vertical plane. The horizontally actuated transfer channel makes the lock system easy for the user to activate.

One embodiment of the lock system of the present invention is also designed to be easily serviced. As key locks are routinely serviced for code changes, the lock system of the present invention is designed with a "hairpin" clip underneath the key lock that provides easy access to the lock system. The lock system of the present invention may also be configured with a remote entry locking mechanism.

In a preferred embodiment of a lock system of the present invention, the lock system may be engineered with a status indicator or indicators. These indicators provide visual notice to the owner of the item to be secured that all systems are in a locked or unlocked position. Accordingly, a quick visual check on the lock of the present invention will provide assurance that the system is secured. Known locks do not have built in status indicators which provide this notice function. Therefore, with known locks, manual checking of all locks is required to determine the status of the system.

In one embodiment of the present invention, the status indicators, for example LEDs, are integral to the lock itself. The integral status indicators allows the feature to be used in many different systems without need for changing the configuration of the system to be secured. The integral status indicators may be used, for example, with a remote entry lock system. When used with a remote entry lock system, it is preferred that the status indicators may be controlled from sensors connected to the remote control system and also from a mechanical override system. Accordingly, the status indicators will accurately provide notice on the status of the lock system regardless of whether remote control or a manual key is used to engage the system.

Thus, the present invention provides many advantages over known lock systems. The lock system of one preferred embodiment of the present invention:

1.) is designed to allow easy locking and unlocking of multiple banks of drawers using a single key lock;

2.) allows manipulation of the lock mechanism by minimal torque making it very comfortable for the user to activate;

3.) is easily adapted to virtually any unit size or drawer configuration;

4.) is adapted with a keyless entry feature;

5.) is adapted with a "key-alike" lock system that is easily changed without disassembling the entire unit; and/or 6.) is adapted with integral sensors that provide visual status indication.

In addition to the features mentioned above, objects and advantages of the present invention will be readily apparent upon a reading of the following description.

BRIEF DESCRIPTION OF THE DRAWINGS

In addition to the novel features and advantages mentioned above, other objects and advantages of the present invention will be readily apparent from the following descriptions of the drawings and preferred embodiments, wherein.

DETAILED DESCRIPTION OF THE PREFERRED EMBODIMENT(S)

The preferred system herein described is not intended to be exhaustive nor to limit the invention to the precise forms disclosed. The embodiments are chosen and described to explain the principles of the invention and the application of the method to practical uses, so that others skilled in the art may practice the invention.

Figure 1:
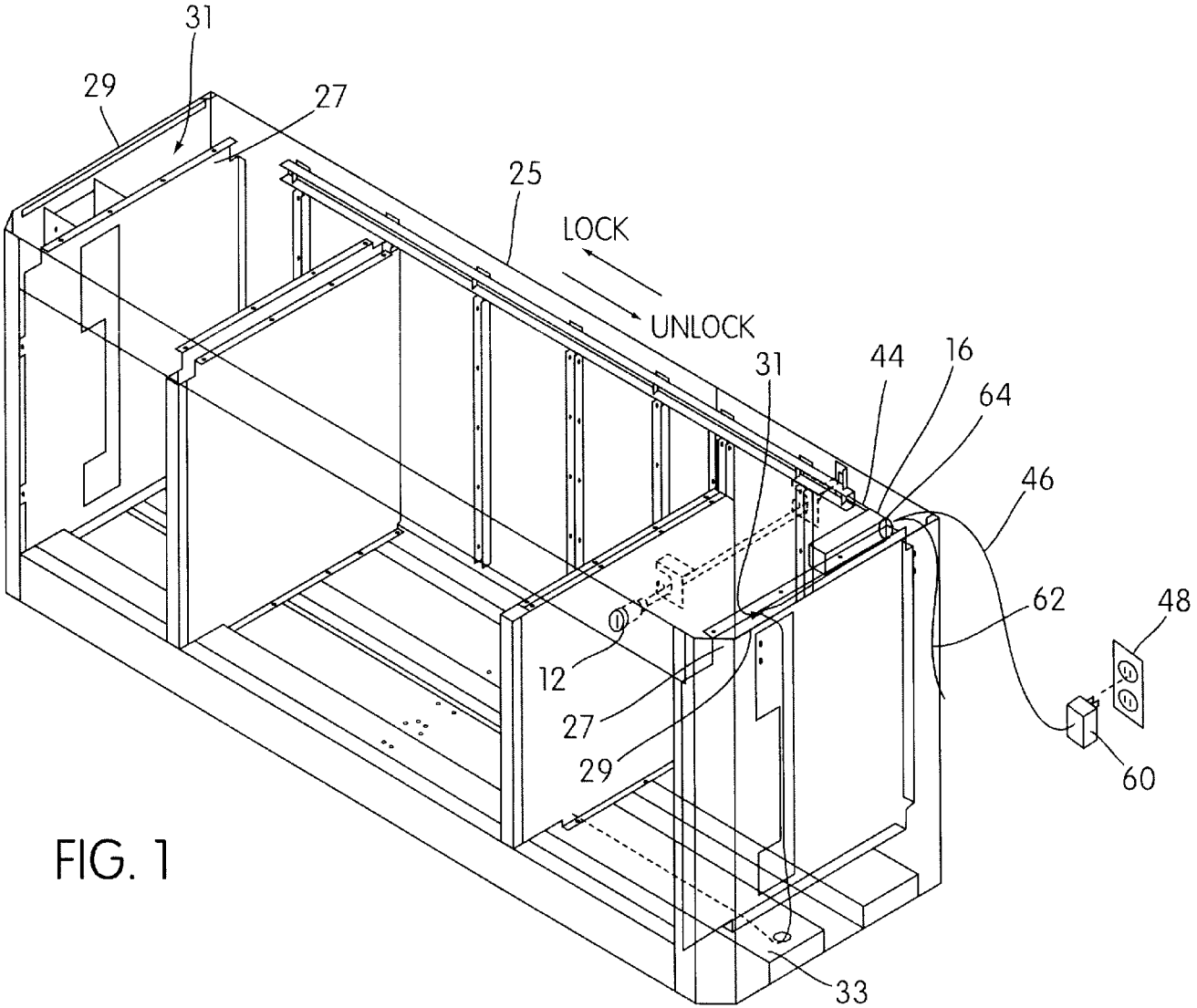
FIG. 1 illustrates a perspective view of one embodiment of a lock system of the present invention.

FIG. 1 is a perspective view of a preferred embodiment of a lock system 10 of the present invention installed on a workstation 11 described below. While the lock system of the present invention is shown installed on a particular embodiment of a workstation 11, it is again emphasized that the lock system 10 of the present invention may also be used with various other workstations or tool chests, including, but not limited to, a one-piece workstation, and also other apparatus outside the tool storage art. The locking system 10 of the FIG. 1 is designed to easily lock and unlock multiple banks of drawers using a single key lock 12. The key lock 12 may easily be serviced based on a "hairpin" clip 14 design. The horizontal actuation of the lock system 10 of the present invention requires minimal torque at the key (e.g. less than 5 in-lbs) making it very comfortable for the user to activate. Unlike traditional vertical lifting lock systems, the rotary action lock system activates with horizontal movement. As a result, during activation, the system of the present invention does not operate against the force of gravity. Based on this low torque activation, a low power remote entry module 16 may be used to activate the lock system 10.

Figure 2:
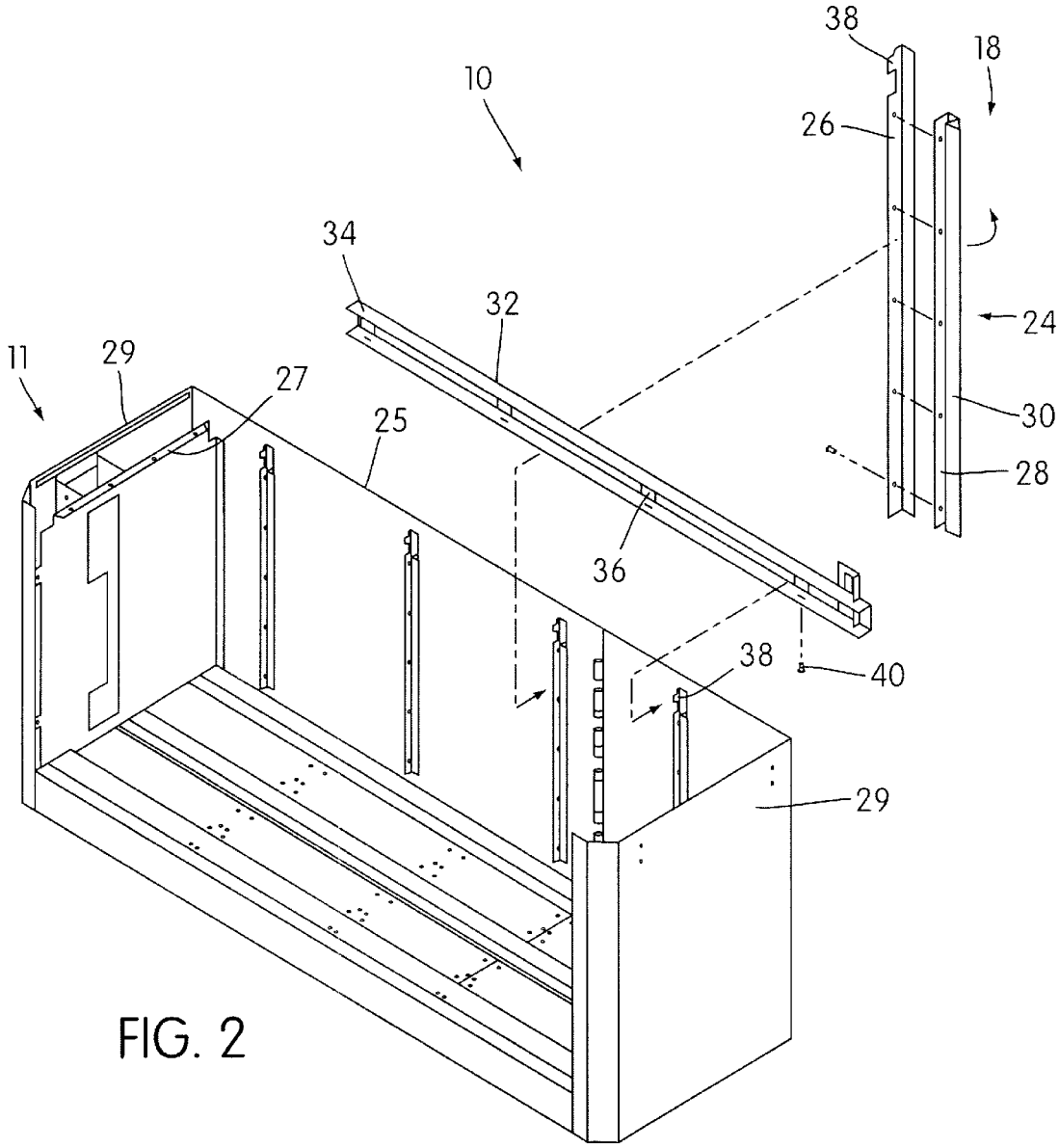
FIG. 2 illustrates an exploded view of portions of one embodiment of a lock system of the present invention.
Figure 3:
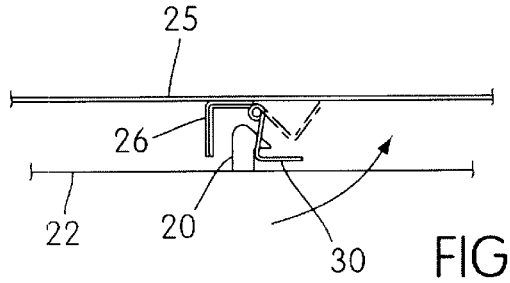
FIG. 3 illustrates one embodiment of a drawer interface in a preferred embodiment of a lock system of the present invention.
Figure 6:
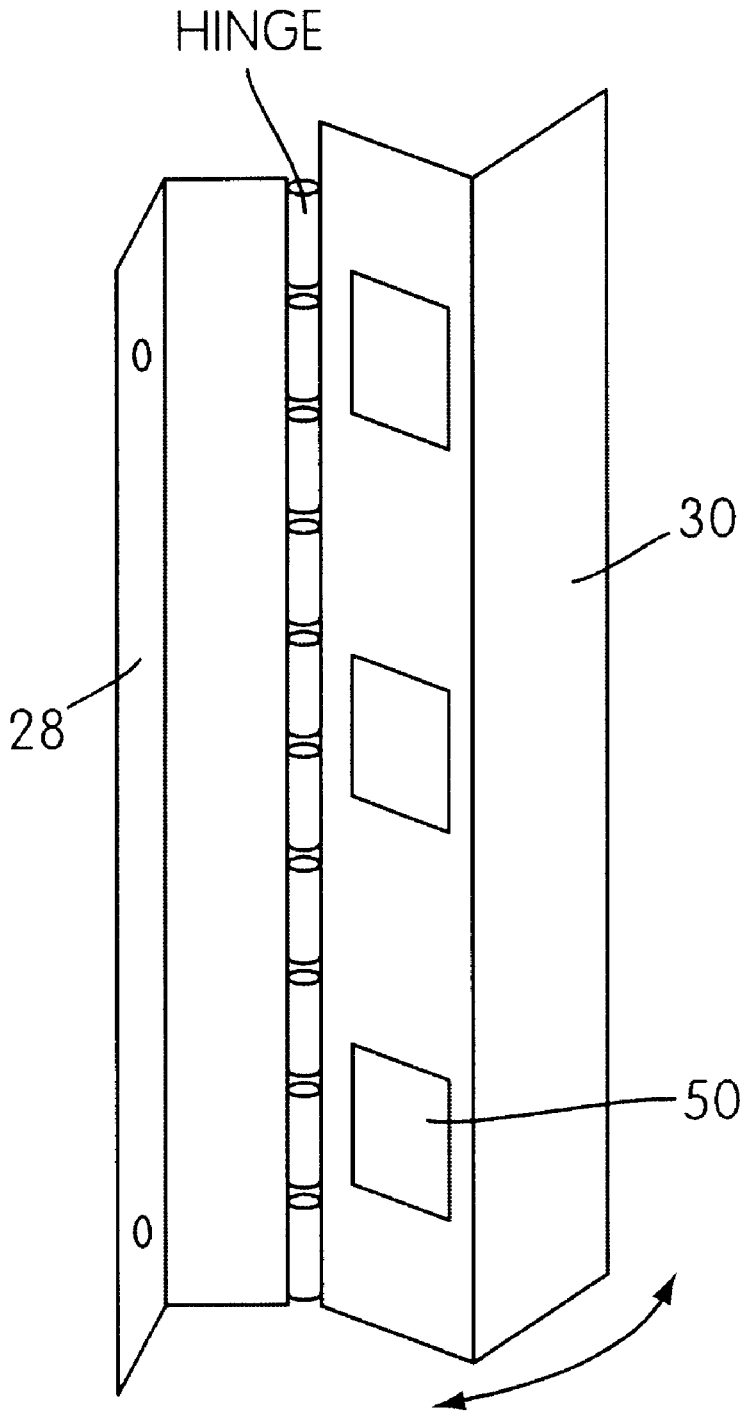
FIG. 6 is a perspective view of a preferred embodiment of a lock hinge of the present invention.

FIG. 2 illustrates an exploded view of portions of one embodiment of the lock system 10 of the present invention. A lock mechanism 18 acts to engage a retaining means 20 on the back portion of each of the drawers 22. In one embodiment, each of the lock mechanisms 18 is a lock hinge 24 attached to a vertical angle 26 and located on the back panel of the workstation (see FIG. 6 for an enlarged, perspective view of the lock hinge). It is preferred that the lock hinge 24 be comprised of a stationary leaf portion 28 and a moving leaf portion 30. In this preferred embodiment, the moving leaf portion 30 of the lock mechanism 18 rotates in the counterclockwise direction to unlock the drawers 22. (FIG. 3 illustrates a top plan view illustrating the lock mechanism 18 and drawer 22 interface details.) It is also preferred that the lock hinge 24 be spring loaded and possess a 90 degree stop angle. As illustrated in FIG. 3, the moving leaf portion 30 of the lock mechanism 18 will rotate approximately 45 degrees counterclockwise (looking down from the top) as the system activates from a locked to an unlocked position. The moving leaf 30 portion preferably has a series of rectangular slots 50. These rectangular slots 50 engage the retaining means 20 on the back of each drawer 22 when the moving leaf portion 30 is in the locked position.

Although in FIG. 3, a horse-head retaining means is illustrated, it is appreciated that other retaining means may be used. For example, a hook-latch retaining means may be used if the lock mechanism 18 contains hooks as opposed to engaging slots. It is also preferred that the lock mechanism 18 be vertically situated along the back of the unit, so that the lock mechanism 18 can simultaneously lock and unlock all the drawers 22 of a bank of drawers.

The lock hinges 24 are activated by a transfer mechanism 32 that runs horizontally across the back of the workstation. In a preferred embodiment, the transfer mechanism 32 is a transfer channel 34. The transfer channel 34 is preferably positioned behind a portion of each of the multiple banks of drawers. Rectangular slots 36 in the transfer channel 34 fit into tabs 38 at the top of the vertical angles 26 located on the back panel of the workstation. The tabs 38 guide the transfer channel 34 as it moves left to right while preventing the channel 34 from rotating. It is preferred that plastic spacers 40 be screwed to a bottom flange of the transfer channel 34. These spacers 40 move the moving leaf portion 30 of the lock hinge 24 as the transfer channel 34 moves horizontally to the unlocked position (in an alternative embodiment the plastic spacers may also be configured to move the hinge to a locked position). In the preferred embodiment of the present invention illustrated in FIGS. 1–5, the moving leaf portion 30 is moved from the locked to the unlocked position as the spacers 40 move to the right of the unit. To lock the drawer, the transfer channel 34 is activated to return to the left position, wherein the spacers 40 also move to the left. The moving of the spacers 40 to the left allows the moving leaf portion 30 of the spring-loaded lock hinge 24 to return to the locked position. Although this embodiment of the present invention has been described utilizing spacers 40 to transfer movement of the transfer channel 34 to the moving leaf portion 30, it should be appreciated that components other than spacers 40 may be used to activate the lock hinge 24 as well.

Figure 5:
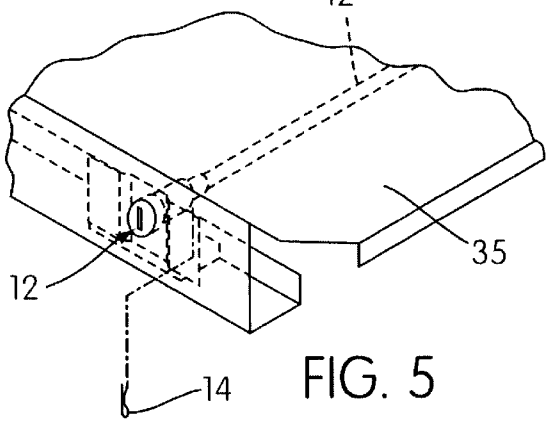
FIGS. 4–5 illustrate one embodiment of a key lock and lockrod of the present invention.
Figure 4:
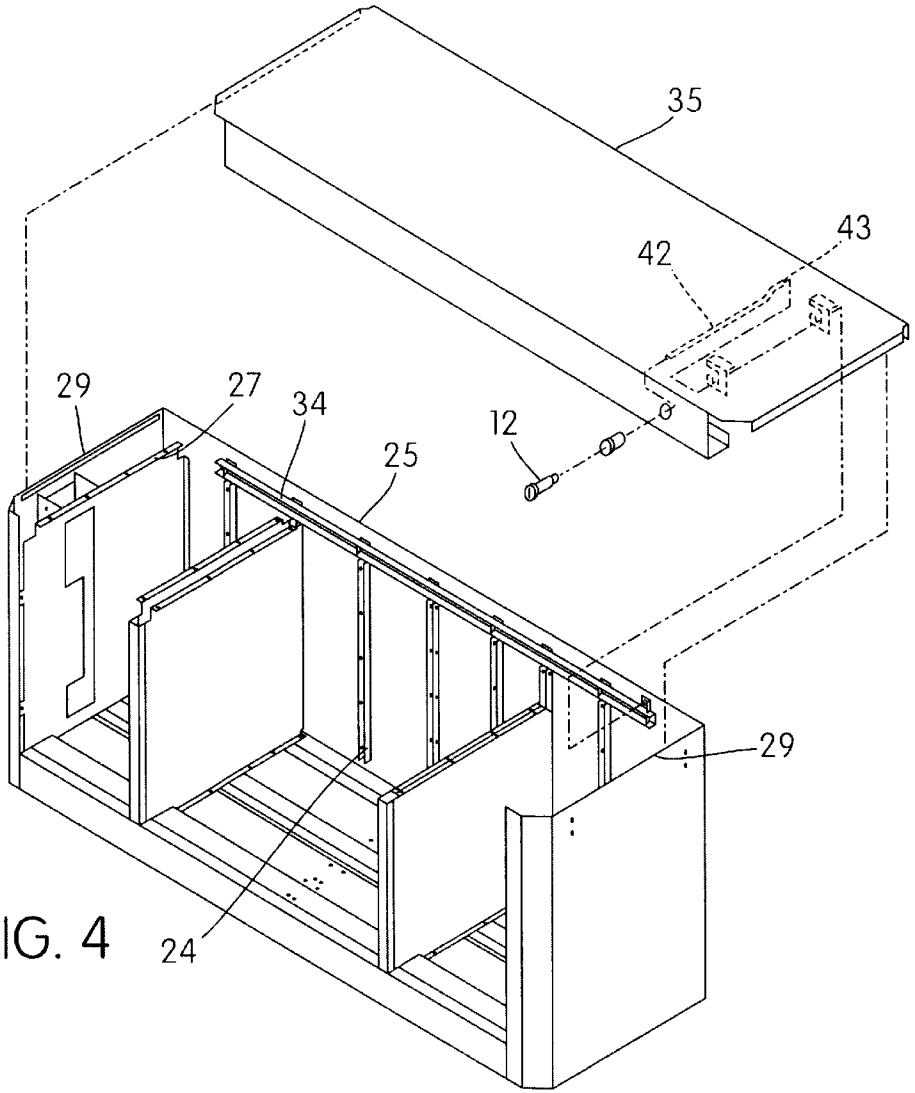

The transfer channel 34 is preferably activated to move in the horizontal direction via a lockrod system 42. FIG. 4 illustrates an exploded view of one embodiment of the lockrod system 42 of the present invention. FIG. 5 illustrates a preferred embodiment of the key lock 12 of the present invention. In the embodiment of the present invention illustrated in FIGS. 4–5, the rear of the lockrod 42 is bent to provide an offset portion 43 that rotates 180 degrees when the key lock is turned. The offset portion 43 in the lockrod 42 applies pressure to a bearing surface on the transfer channel 34. The transfer channel 34 displaces left to right the horizontal distance traveled by the 180 degrees rotation of offset portion 43 in the lockrod 42 (approximate 0.54" in one embodiment). This linear movement of the transfer channel 34 generates approximately 45 degrees of rotation in the lock hinges 24. In this preferred embodiment, the lockrod 42 and the key lock 12 are connected by a hairpin clip 14. The hairpin clip 14 may be easily removed allowing the key lock 12 to be removed and replaced.

Figure 7:
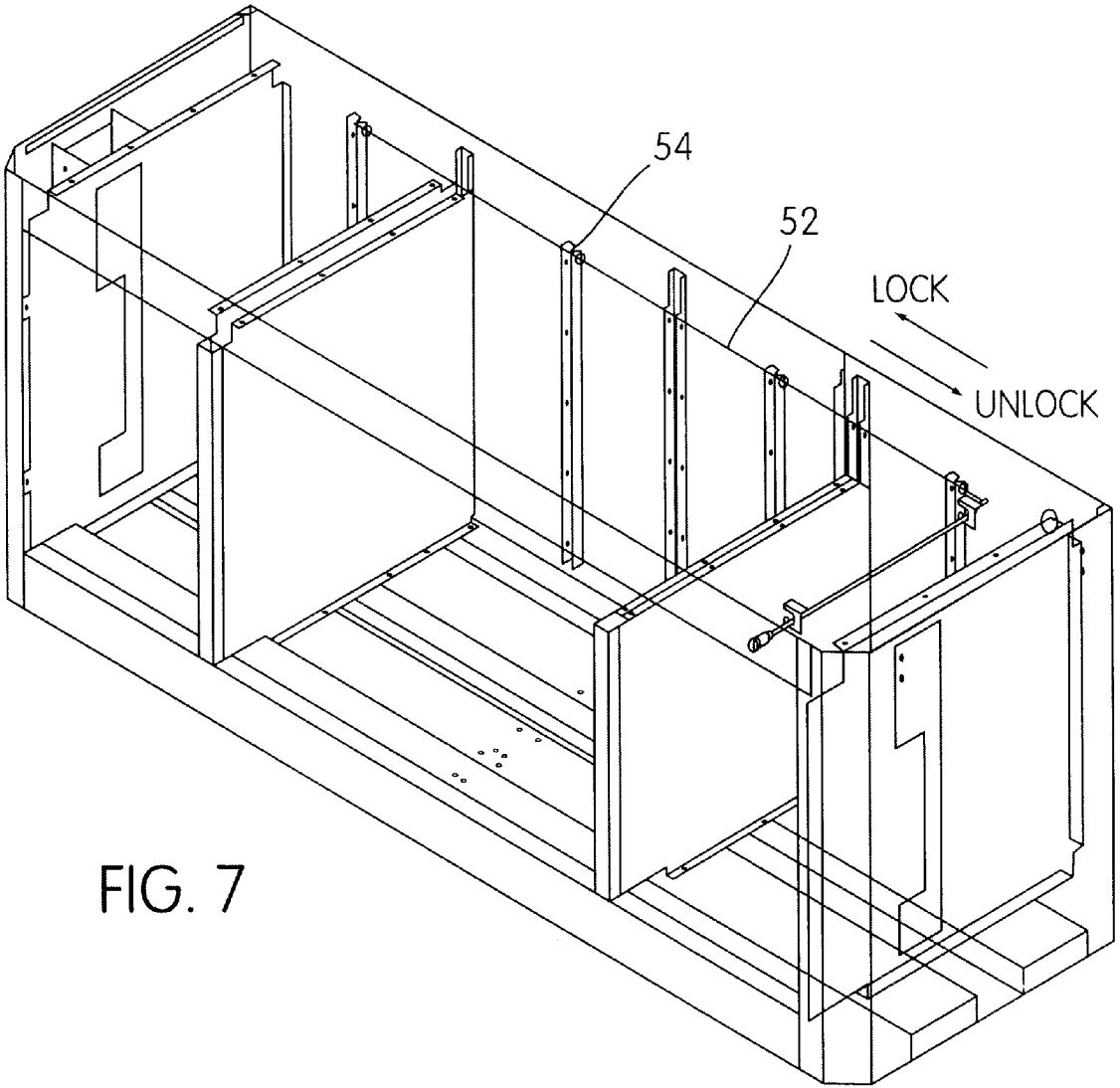
FIG. 7 illustrates an embodiment of a workstation having a cable as the transfer mechanism.

In another embodiment of the present invention, illustrated in FIG. 7, the transfer mechanism is a cable 52. The cable 52 may have loops or rings 54 that engage holes placed in the moving leaf portions 30 of the hinges 24. Horizontal movement of the cable 52 acts to move the moving leaf portion 30 from the unlocked position.

In a preferred embodiment of the present invention, the lock system 10 may be activated by remote entry. One embodiment of a remote entry module 16 is illustrated in FIG. 1. The remote entry module 16 is preferably a self-contained unit having a DC solenoid, receiver and battery back-up. Instead of a solenoid, a low power, low amperage, motor may be used to actuate movement of the transfer channel 34. The solenoid actuator connection or motor connection to the transfer channel 34 is shown generally at 44. The remote entry module 16 preferably has a DC power line 46 that interfaces to an AC wall outlet 48 via plug-in AC-DC power converter 60. The antenna 62 for the receiver may be routed through a knock-out portion 64 of the back panel 25, or across the inside panel 27, into the hat section space 31 between the inside panel 27 and outside panel 29 and through a hole in the base portion 33 to the underside of the unit (see FIG. 1).

The remote entry module 16 may be mounted to the back panel 25 of the unit via mounting holes provided in an upper portion of the inside of the back panel 25, top panel 35 and the transfer channel 34. It is also preferred that the back panel 25 contain a "knock-out" portion 64 which allows for easy access to the remote entry module 16 (the "knock-out" portion 64 may be separately locked).

As described, the lock system 10 of the present invention provides an improved lock system that is manipulated by low torque, that is easily serviceable once installed, and which may be easily configured for different types, sizes or configurations of workstations. For example, the lock system 10 of the present invention may be easily configured for installation into workstations having various drawer arrangements. Virtually any drawer arrangement may be accommodated by installing a lockrod 42, a transfer channel 34 and a lock hinge 24, and by placing vertical lock mechanisms 18 in predetermined locations on the back panel of the modular workstation corresponding to each bank of drawers, as described above.

Figure 8C:
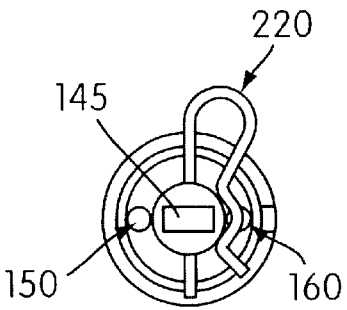
FIGS. 8 A–C illustrate one embodiment of the lock system of the present invention having a key lock with integral status indicators.
Figure 8B:
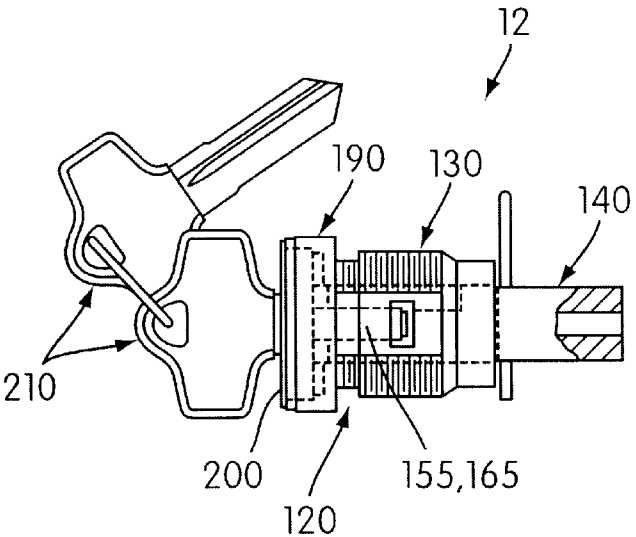
Figure 8A:
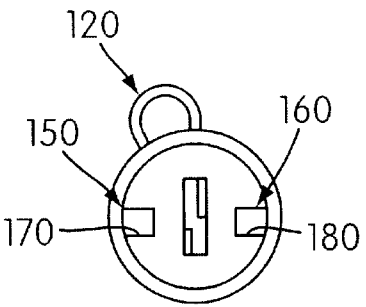

FIGS. 8A–8C illustrate a preferred embodiment of a key lock 12 of the lock system 10, wherein the key lock has integrated status indicators 150, 160. In FIG. 8A, a front elevational view, the status indicators 150, 160 are visible through apertures 170, 180 in a cover 190 that is preferably affixed to the face 200 of the key lock 12. Preferably, the status indicators 150, 160 consist of light emitting diodes (LED's) 155, 165 and are utilized to provide visual notice to the user of the storage device that the storage device is in a locked or unlocked state.

Referring to the side elevational view of FIG. 8B, the key lock 12 is shown to be comprised of a shell portion 130 and a core portion 140. The core portion 140 refers to the rotating center portion of the lock mechanism that contains the individual tumblers and springs. The core portion 140 preferably has a first end attached to a face surface 200 that accepts a key 210, and a second end which houses a rectangular drive coupler 145. The face surface 200 of the key lock 12 preferably contains two apertures 170, 180 to permit light to travel from the LED's 155, 165 and through the face cover 190, thereby acting as status indicators 150, 160. The face cover 190 may be imprinted with various symbols or wording. The bore of the shell portion 130 accepts the tumblers of the lock core portion 140 and serves as a pass-through for the rectangular drive coupler 45. The shell portion 130 is also preferably provided with cavities for housing the LED's 155, 165. The shell portion 130 may be designed to allow access to the LED's 155, 165 without requiring disassembly of the key lock 12. The shell portion 130 and the LED's 155, 165 are stationary in this embodiment, however, if the LED's are made part of the core portion 140 or the face piece 200, they may rotate when the lock is actuated. The core portion 140 and shell portion 130 may be held together by a hairpin clip 220 (FIGS. 8A and 8C), although other methods of joining are possible.

It is contemplated that either a red or green LED will illuminate to indicate the security condition of the tool storage unit or cabinet, however, other colors may also be used. The electrical signal to the LED's 155, 165 may be generated from sensing electronics residing in a sensing device located on the workstation (preferably adjacent to a part of the remote entry locking system, if a remote entry module is used). Depending on the specifics of the transfer mechanism used, known sensing devices (electrical, magnetic or mechanical) may be calibrated to sense when the lock is in the "Unlocked" or "Locked" state. The sensing device in the remote entry embodiment of the present invention preferably allows sensing of the remote entry activation system and the mechanical override system to provide signals to the LED's 155, 165. Accordingly, the status indicators 150, 160 will be accurate regardless of whether the remote entry or mechanical override system was used.

A low power D.C. electrical signal may be used to drive the LED's155, 165 in a continuous or pulsing (flashing) manner. Electrical connection from the sensing device to the LED's may be made by a traditional stranded wiring, for example.

Figure 9C:
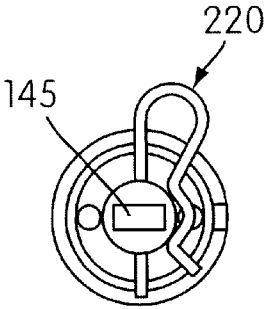
FIGS. 9A–C illustrate another embodiment of the lock system of the present invention having a key lock with integral status indicators.
Figure 9B:
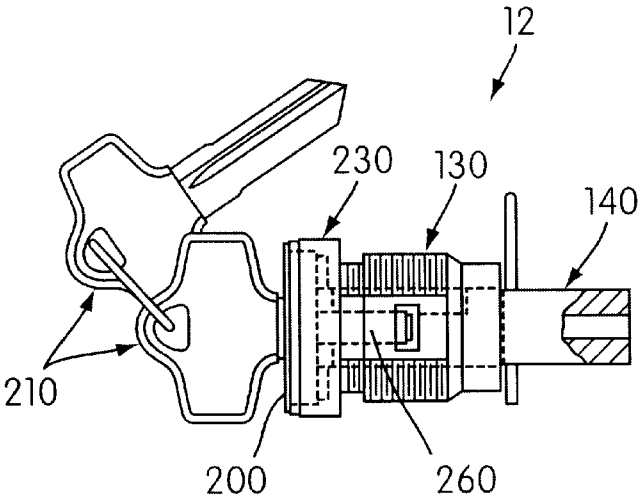
Figure 9A:
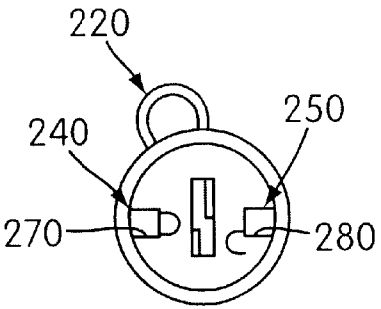

FIGS. 9A–9C illustrate another embodiment of a key lock 12 of the lock system 10 of the present invention. More specifically, FIGS. 9A–9C illustrate a mechanical key lock 12 having one LED 260 and a plurality of lenses 270, 280 for indicating the status of the lock (i.e., "Unlocked" or "Locked"). The key lock 12 in FIG. 9 possesses a 180 degree rotation but the invention will work with different rotation angles other than 180 degrees.

The embodiment of FIG. 9 illustrates a key lock 12 similar to the embodiment of FIG. 8, except that only one LED 260 is secured to the shell portion 130 of the key lock. In this particular embodiment, a plastic face cover 230 is attached to the face portion 200 of the key lock 12. As can be seen in FIG. 9A, the plastic face cover 230 may have a red lens 240 and a green lens 250 to act as "Locked" and "Unlocked" status indicators 270, 280 respectively. Of course, other colors may be employed for the lenses 240, 250 as well. In an "Unlocked" state the green lens 250 will be over the LED 260 and in a "Locked" state, the red lens 240 will be over the LED 260. An electrical signal originating from a switch or a low amperage transistor battery may be used to drive the LED 260 in a continuous or intermittent state. As shown in FIG. 9A, the lenses 240, 250 may be in the shape of a "locked" or "unlocked" lock, or may be words, for example.

The scope of the invention is not to be considered limited by the above disclosure, and modifications are possible without departing from the spirit of the invention as evidenced by the following claims.

What is claimed is:

1. A key lock for use on a storage device, said key lock comprising:

a core portion having a first end and a second end;

a shell portion surrounding at least a segment of said core portion;

a face portion attached to said first end of said core portion;

a cover with a key opening affixed to said face portion;

at least one LED secured within said lock for indicating the locked status of said storage device; and a sensing device for detecting whether said storage device is in a locked or unlocked condition, said sensing device in communication with said at least one LED, wherein said cover is adapted to allow at least a portion of the light from said at least one LED to pass through, thereby indicating the locked status of said storage device.

2. The key lock of claim 1, wherein said cover has at least one aperture for allowing light from said at least one LED to pass through and be visible to a user.

3. The key lock of claim 1, wherein said key lock has two LED's.

4. The key lock of claim 3, wherein said two LED's are of different color.

5. The key lock of claim 3, wherein said cover has two apertures, said two apertures designed to be aligned with said two LED's when said key lock is in either a locked or unlocked position.

6. The key lock of claim 1, wherein said at least one LED resides in said shell portion.

7. The key lock of claim 1, wherein said core portion and said shell portion are joined by a hairpin clip.

8. The key lock of claim 1, further comprising a coupling device on said second end of said core portion for coupling said key lock to other components of a lock system.

9. The key lock of claim 1, wherein said cover has at least one lens, said lens designed to be aligned with said at least one LED when said key lock is in one of either a locked or unlocked position, thereby illuminating said lens.

10. The key lock of claim 1, wherein said cover has two lenses that may be illuminated by said at least one LED to indicate the status of said storage device.

11. The key lock of claim 10, wherein said lenses are of different color.

12. The key lock of claim 10, wherein one of said two lenses is adapted to be aligned with said at least one LED when said key lock is in an unlocked position, and the other of said two lenses is adapted to be aligned with said at least one LED when said key lock is in a locked position.

13. The key lock of claim 10, wherein one of said two lenses is uniquely shaped to indicate the unlocked condition, and the other of said two lenses is uniquely shaped to indicate the locked condition.

14. The key lock of claim 13, wherein said lens shaped to indicate the unlocked condition is illuminated by said at least one LED when said storage device is in the unlocked condition, and said lens shaped to indicate the locked condition is illuminated when said storage device is in the locked condition.

15. The key lock of claim 1, wherein said at least one LED is activated in response to a signal from the sensing device.

16. The key lock of claim 1, further comprising a remote control system for locking or unlocking said storage device.

17. The key lock of claim 1, wherein said at least one LED is battery powered.

18. The key lock of claim 1, wherein said at least one LED is powered by a DC converter plugged into a standard AC wall outlet.

19. The key lock of claim 1, wherein said at least one LED is equipped with a lens that reflects color.

20. The key lock of claim 1, wherein said key lock includes two LED's, each of said LED's emitting a different color, one of said different colors indicating the locked condition and the other of said different colors indicating the unlocked condition.

21. A method for indicating the status of a storage device, said method comprising the steps of:

providing at least one LED in a key lock;

providing said key lock in said storage device;

providing a cover on said key lock, said cover having a structure to indicate whether said storage device is in a locked or unlocked condition;

providing a power source for said at least one LED;

providing a sensing device between said at least one LED and said power source, said sensing device adapted to detect the locked or unlocked condition of the storage device;

sending an electrical signal to the at least one LED in response to the sensing device; and providing that the indicating structure on said cover is properly located over said at least one LED, so as to indicate whether said storage device is locked or unlocked;

whereby, the locked or unlocked condition of said storage device may be ascertained by visual observation.

* * * * *